United States Patent [19]

Townsend et al.

[11] Patent Number: 4,700,726

[45] Date of Patent: Oct. 20, 1987

[54] CIGARETTE RODS HAVING SEGMENTED SECTIONS

[75] Inventors: David E. Townsend, Winston-Salem; Diane R. Frye, King; Tammie B. Greene; Thomas A. Perfetti, both of Winston-Salem, all of N.C.

[73] Assignee: R. J. Reynolds Tobacco Company, Winston-Salem, N.C.

[21] Appl. No.: 858,790

[22] Filed: May 2, 1986

[51] Int. Cl.[4] ..... A24D 1/00; A24D 1/18

[52] U.S. Cl. ..... 131/364; 131/360

[58] Field of Search ..... 131/331, 363, 364, 360

[56] References Cited

U.S. PATENT DOCUMENTS

| | | |
|---|---|---|
| 1,721,117 | 7/1929 | Hopkins . |
| 1,796,522 | 3/1931 | Hopkins . |
| 1,920,708 | 8/1933 | Molins . |
| 3,146,780 | 9/1964 | Harrison, Jr. et al. . |
| 3,516,417 | 6/1970 | Moses . |
| 3,604,429 | 9/1971 | DeWitt . |
| 3,664,350 | 5/1972 | Wall . |
| 3,759,267 | 9/1973 | Thornton . |
| 3,773,053 | 11/1973 | Stephens, Jr. . |
| 3,902,504 | 9/1975 | Owens, Jr. et al. . |
| 3,916,914 | 11/1975 | Brooks et al. . |
| 4,009,722 | 3/1977 | Wahle et al. . |
| 4,328,817 | 5/1982 | Naylor et al. . |
| 4,548,215 | 10/1985 | Adebahr . |
| 4,580,579 | 4/1986 | Wahle et al. . |
| 4,595,024 | 6/1986 | Greene et al. . |

*Primary Examiner*—V. Millin

[57] ABSTRACT

Cigarette rods include four segments of smokable material. First and second segments are positioned at the extreme ends of the rod. The first segment is positioned at the end of the rod to be lit. A third segment is positioned adjacent the first segments, and a fourth segment is positioned adjacent the second segment. The density of the third segment is greater than the fourth segment. The first and second segments can be "dense ends" or "loose ends" relative to the respective adjacent segments.

23 Claims, 2 Drawing Figures

CIGARETTE RODS HAVING SEGMENTED SECTIONS

BACKGROUND OF THE INVENTION

This invention relates to smoking articles such as cigarettes.

In the manufacture of smoking articles such as cigarettes, design parameters can be varied in order to control properties thereof. For example, properties such as the tobacco smoke delivery profile can be varied in order to control the composition of the tobacco smoke during use of the cigarette. Typical parameters which are varied include the choice of tobacco additives and/or cigarette paper additives, the permeability of the cigarette paper, the composition of the tobacco or blend of smokable materials, the strand width of the smokable material, the filling capacity of the smokable material, the properties of the filter element which is employed, and the like.

An ability to change the smoke delivery profile of the cigarette allows the manufacturer to provide cigarettes exhibiting varying perceived sensory characteristics. Such characteristics can be varied from cigarette to cigarette and/or from puff to puff during use of a particular cigarette.

U.S. Pat. No. 4,328,817 discloses a cigarette rod wherein the packing density of the tobacco decreases continuously along the length of the rod in the direction away from the end which is to be lit. Such cigarettes are proposed as being capable of providing reduced total particulate matter and carbon dioxide deliveries. However, the reference does not propose a modification of the per puff deliveries of such cigarettes. The ability to control the per puff deliveries of cigarettes is desirable in that the user experiences cigarette mainstream smoke in a discrete series of puffs rather than in terms of the total cigarette characteristics. For example, typical cigarettes provide deliveries of tar and nicotine which increase during use thereof. Thus, the smoke delivery profile of a cigarette is such that the user often experiences an undesirable increase in perceived strength from puff to puff.

It would be highly desirable to provide a cigarette which is capable of being manufactured such that the smoke delivery profile thereof can be readily controlled.

SUMMARY OF THE INVENTION

This invention relates to a rod suitable for the manufacture of a cigarette. The rod comprises filler material contained in a wrapping material, and the two ends of the rod are open to expose the filler material. The rod comprises four segments of filler material wherein each segment is defined by its density. A first segment is disposed at the extreme end of the rod which is to be lit. A second segment is disposed at the end of the rod opposite the end which is to be lit. A third segment is disposed adjacent to the first segment. A fourth segment is disposed adjacent to the second segment. Each of the third segment and fourth segment has a substantially uniform density in the region along the longitudinal axis of the rod and across the rod in a plane perpendicular to the longitudinal axis thereof. The density of the fourth segment is less than that of the third segment such that the density differential therebetween is at least about 15 percent.

In another aspect, this invention relates to a filter cigarette comprising the aforementioned rod and a filter element axially aligned therewith at the end of the rod adjacent to the aforementioned second segment thereof.

This invention provides for the efficient and effective preparation of cigarette rods. Of particular interest is the ability to provide a cigarette having a smoke delivery profile such that the user perceives a relatively constant nicotine delivery during use thereof. For example, smooth smoking cigarettes can be provided. Alternatively, cigarettes can be provided exhibiting smoking characteristics which provide the perceived impression of low or high strength for a particular level of delivered particulate matter.

DETAILED DESCRIPTION OF THE EMBODIMENTS

Figure 1:
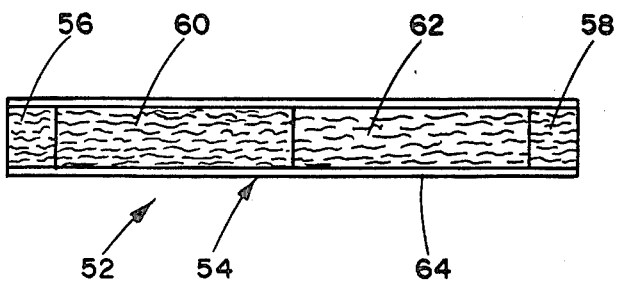
FIG. 1 is a diagrammatic cross sectional illustration of a cigarette rod showing the four segments of filler material.
Figure 2:
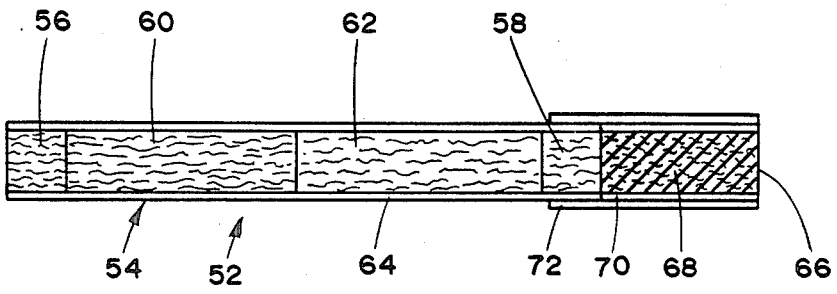
FIG. 2 is a diagrammatic cross sectional illustration of a cigarette showing the rod of FIG. 1 and a filter element attached at one end thereof.

Embodiments of this invention shown in FIGS. 1 and 2 are each smoking articles 52 in the form of cigarettes. Each cigarette comprises a generally cylindrical rod 54 having four segments of filler material. Typically, the length of the rod ranges from about 55 mm to about 85 mm, and the circumference of the rod ranges from about 20 mm to about 26 mm. The first segment 56 is positioned at the end of the cigarette which is to be lit. Second segment 58 is positioned at the end of the rod opposite that end where the first segment is positioned. Third segment 60 is positioned adjacent the first segment. Fourth segment 62 is positioned adjacent the second segment. The segments each are aligned in an abutting, end-to-end relationship. The segments are contained in circumscribing wrapping material 64 which is manufactured into a tube-like shape thereby forming the rod. Typically, the wrapping material is a conventional cigarette wrapping paper. The ends of the rod are open to expose the filler material.

For the embodiment shown in FIG. 2, the smoking article further comprises filler plug 66 positioned adjacent to one end of rod 54 such that the filter plug is axially aligned with the rod in an end-to-end relation. The filter plug is positioned adjacent second segment 58 of rod 54. Filter plug 66 has a substantially cylindrical shape, and the diameter thereof is substantially equal to the diameter of the rod. Preferably, the filter plug substantially abuts the rod. The ends of the filter plug are open to permit the passage of air and smoke therethrough. The filter plug includes filter element 68 which is overwrapped along the longitudinally extending surface thereof with circumscribing wrap material 70. The filter element can be constructed from cellulose acetate, or other suitable material. The wrap material can be air impermeable or air permeable material such as conventional paper plug wrap. However, if desired a nonwrapped cellulose acetate plug can be employed. Typically, the longitudinally extending length of the filter plug ranges from about 20 mm to about 35 mm. Filter plug 66 is attached to rod 54 by tipping material 72 which circumscribes both the filter plug and an adjacent region of the rod. The inner surface of the tipping material is fixedly secured to the outer surface of the filter plug and to the outer surface of the wrapping material of an adjacent region of the rod. The tipping material circumscribes the rod about a longitudinal length which can vary, but is typically that length sufficient to provide good attachment of the filter plug to the rod. Typically, the tipping material is either a conventional air impermeable or air permeable tipping material such as tipping paper. If desired, openings such as slits, holes or perforations in the substantially air impermeable tipping material and plug wrap can provide a means for air dilution of the smoking article.

Filler materials most preferably include smokable materials. Examples of smokable materials include tobacco materials such as cured or processed tobacco, reconstituted tobacco, tobacco substitute materials, blends thereof, and blends thereof with pyrolyzed or carbonized materials. Blends of tobaccos are particularly desirable. Filler materials can be employed in various manners. Typically, smokable material is employed as a charge of strands filler (i.e., as strands of material provided at from about 15 to about 70, most preferably at about 32 cuts per inch, and optionally treated wih conventional additives such as flavorants and humectants).

The term "density" in referring to the individual segments of filler material means the weight of that segment of the rod per unit volume of the segment.

The term "segment" in referring to the rod means the portion of the rod including the total cross sectional portion of the rod, extending longitudinally along the rod, and bounded by a plane at each end of the segment, which plane is positioned substantially transversely to the longitudinal axis of the rod. For a substantially cylindrical rod, the four required segments form four substantially cylindrical shaped segments, and are each aligned in an essentially abutting and end-to-end relationship. The boundary between each of the various substantially cylindrical shaped segments is relatively abrupt, providing a discrete, rapid transition of filler material therebetween. It is particularly desirable that at least the third and fourth segments be substantially cylindrical shaped and have a relatively abrupt boundary at the ends thereof. The density of each of the first and second segments can vary throughout the respective segments.

The manner in which the density of each segment of filler material can be obtained can vary. Generally the manner of packing the filler material can affect the relative density of a particular segment. For example, filler material packed with a relatively low void volume can provide a relatively dense segment as compared to a segment provided by loosely packed filler material of similar composition. Alternatively, small size particles or thin strands of filler material can provide a relatively dense segment as compared to a segment provided by larger sized, similarly packed particles or strands of similar composition. In addition, additives (such as moisture) to the filler material of a particular segment can provide increased density to a segment as compared to a segment wherein similar filler material is untreated with additive. Furthermore, relatively dense filler material can provide a relatively dense segment as compared to a segment provided by similarly packed filler material of a lower density. For example, filler material can be selected from relatively dense tobacco material such as reconstituted tobacco, or a dense leaf such as oriental tobacco or the so called "Green River" tobaccos. Blends having large amounts of relatively dense tobacco materials can be employed. Alternatively, a low density tobacco material can be obtained from a less dense leaf such as low stalk flue cured tobacco or low stalk burley tobacco. Low density filler material also can be provided by employing foamed reconstituted tobacco, by employing expanded tobacco, by employing supercritically expanded tobacco, or other such materials. Blends having large amounts of low density tobacco materials can be employed. For example, the smokable material of the first and third segments can be volume expanded. However, if desired, the smokable material of the second and fourth segments can be volume expanded. It is understood that density differentials between the segments (particularly between the third and fourth segments) can be varied by varying one or more of the aforementioned methods for providing filler materials of various densities.

The density of the fourth segment is less than the density of the third segment. The density differential between the third and fourth segments is at least about 15 percent. Preferably, the density differential is between about 20 percent and about 270 percent, most preferably between about 30 and about 130 percent.

For purposes of this invention, the term "density differential" means one hundred times the quantity of the density ratio of the fourth segment to the third segment minus one.

The amount which each of the various segments extends longitudinally along the rod can vary. In one embodiment, the first segment can have a density greater than the adjacent third segment, while the second segment can have a density greater than the adjacent fourth segment (i.e., the first and second segments are so called "dense ends"). Typically, in such an embodiment, the combined longitudinal length of the first and third segments ranges from about 20 to about 80, preferably from 30 to about 70 percent of the total length of the rod, while the length of the first segment ranges from about 8 to about 20 percent of the total length of the rod; and the combined longitudinal length of the second and fourth segments ranges from about 20 to about 80, preferably about 30 to about 70 percent of the total length of the rod, while the length of the second segment ranges from about 8 to about 20 percent of the total length of the rod. In another embodiment, the first segment can have a density less than the adjacent third segment, while the second segment can have a density less than the adjacent fourth segment (i.e., the first and second segments are so called "loose ends"). Typically, in such an embodiment, the combined longitudinal length of the first and third segments ranges from about 20 to about 80, preferably about 30 to about 70 percent of the total length of the rod, while the length of the first segment ranges from about 2 to about 5 percent of the total length of the rod; and the combined longitudinal length of the second and fourth segments ranges from about 20 to about 80, preferably about 30 to about 70 percent of the total length of the rod, while the length of the scond segment ranges from about 2 to about 5 percent of the total length of the rod. In yet another embodiment, the first segment can have a density greater than the density of the adjacent third segment, while the second segment can have a density less than the adjacent fourth segment (i.e., the first segment is a so called "dense end" and the second segment is a so called "loose end"). Typically, in such an embodiment, the combined longitudinal length of the first and third segment ranges from about 20 to about 80, preferably about 30 to about 70 percent of the total length of the rod, while the length of the first segment ranges from about 18 to about 42 percent of the total length of the rod; and the combined longitudinal length of the second and fourth segments range from about 20 to about 80, preferably about 30 to about 70 percent of the total length of the rod, while the length of the second segment ranges from about 2 to about 5 percent of the total length of the rod. In still another embodiment, the first segment can have a density less than the density of the adjacent third segment, while the second segment can have a density greater than the adjacent fourth segment (i.e., the first segment is a so called "loose end" and the second segment is a so called "dense end"). Typically, in such an embodiment, the combined longitudinal length of the first and third segments ranges from about 20 to about 80, preferably about 30 to about 70 percent of the total length of the rod, while the length of the first segment ranges from about 2 to about 5 percent of the total length of the rod; and the combined longitudinal length of the second and fourth segments range from about 20 to about 80, preferably about 30 to about 70 percent of the total length of the rod, while the length of the second segment ranges from about 18 to about 42 percent of the total length of the rod.

The amount of nicotine present in the various segments can vary. It is particularly desirable that the nicotine differential be employed between the third and fourth segments, although the relative nicotine content of each segment can be the same. By "relative nicotine content" is meant the amount of nicotine per weight of segment. For purposes of this invention, the term "nicotine differential" means one hundred times the quantity of the ratio of the relative nicotine content of the combined second and fourth segments to the relative nicotine content of the combined first and third segments minus one. It is possible for embodiments to exhibit a positive or negative nicotine differentials. Typically, the nicotine content of each of the segments can range from about 0.05 percent to about 12 percent, based on the total weight of the segment.

Cigarette rods of this invention can be readily provided using the equipment which is capable of providing cigarette rods from two separate blends of filler material. In particular, an apparatus having two feeding mechanisms can be employed in order to provide a continuous rod comprising alternating segments of filler. Such methods of manufacture provide the ability to provide differing filler materials in the respective third and fourth segments. Such methods are believed to provide the ability to manufacture cigarettes at a commercial scale while maintaining strict, definable quality control.

Cigarette rods can be manufactured using the apparatus described in U.S. Pat. No. 4,516,585 to Pinkham, which is incorporated herein by reference. In particular, a variation in the negative pressure zone of the Pinkham apparatus can produce a pocket of filler material of increased packing density. The resulting pocket can be transferred to a perforated belt thus providing continuously alternating zones of filler material each having a low and high packing density. Alternatively, cigarette rods can be manufactured using the apparatus described in U.S. Pat. No. 4,009,722 to Wahle et al., which is incorporated herein by reference. In particular, an increase in the negative pressure associated with the suction wheel of the Wahle apparatus can produce a pocket of filler material having increased packing density. The resulting pocket can be transferred to a transfer station which in turn deposits the pocket of filler material on a perforated belt thus providing essentially equally spaced pockets. Filler material from a second chamber is added to the regions on the belt between the aforementioned pockets. In yet another manner, cigarette rods can be manufactured using the apparatus generally described in U.S. Pat. No. 3,880,171 to Naylor, which is incorporated herein by reference. In particular, the disk knives can be adjusted such that double wedge shapes of filler material are formed rather than the disclosed double wedged portions, thereby providing discrete segments of filler material. For example, trimming disk knives with two grooves therein can act to remove the various segments from the stream of filler material, and the resulting pockets of filler material are of differing depths having a discrete, segmented shape. The periphersal length of each of the pockets can be changed in order to produce pockets of varying widths and depths, which can act to alter the packing density of a particular segment.

The continuous rod is cut to the desired length using a subdividing means such as a cutting knife. The cutting of the rod into the desired lengths can result in one means for providing the first and second segments, wherein each of the segments has an average density which typically differs from (i.e., is less than) the respective adjacent segments by up to about 15 percent. Typically, such first and second segments are referred to as "loose ends." However, if desired, the ends of the rod can be compacted during formation thereof in order to reduce the amount of spillage of filler from the open ends thereof. Compacted rod ends can be provided by employing compression wheels or rotating trimmer disks as are described in U.S. Pat. Nos. 1,920,708 to Molins and 3,604,429 to DeWitt. The compacted ends of so called "dense ends" of the rod typically have average densities up to about 10 percent greater than that of the segment adjacent thereto. The previously described density differential between the third and fourth segments, and the "loose end" or "dense end" configuration of each of the first and second segments, allow the various segments to be defined in terms of their densities.

The following examples are given to further illustrate the invention but should not be considered as limiting the scope thereof. Unless otherwise noted, all parts and percentages are by weight.

EXAMPLE 1

A blend of smokable materials, and in particular, a tobacco blend is provided by mixing about 31 percent burley tobacco, about 49 percent flue cured tobacco, about 13.5 percent processed (i.e., reconstituted) sheet tobacco and 6.5 percent oriental tobacco blend. The tobacco blend is cut into strands at 32 cuts per inch and exhibits a relative nicotine content of 2.09 percent. A portion of the tobacco blend is separated and stored to provide a high density blend, and a portion of the tobacco blend is subjected to volume expansion conditions generally as described in U.S. Pat. No. 3,524,451 to Fredrickson, in order to provide a low density blend. The low density blend exhibits a nicotine content of 2.09 percent.

Cylindrical cigarette rods of 60 mm length and 24.8 mm circumference are provided from each of the two aforementioned tobacco blends and conventional air permeable cigarette paper using an apparatus generally described in U.S. Pat. No. 4,009,722 to Wahle et al. There is also provided a trimmer disk positioned so as to provide "dense ends" to each of the rods so formed. The first and second segments of the rods so provided are the "dense ends" produced by the trimmer disk. The rods so manufactured have first and third segments provided from the high density blend. The first and third segments have combined longitudinally extending lengths of 30 mm. The second and fourth segments of the manufactured rods are provided from the low density blend (i.e., from the volume expanded form of the smokable material of the first and third segments). The second and fourth segments have combined longitudinally extending lengths of 30 mm. The first segment extends 12.5 mm longitudinally along the rod and exhibits an average density of about 4 percent greater than the adjacent third segment. The second segment extends 12.5 mm longitudinally along the rod and exhibits an average density of about 4 percent greater than the adjacent fourth segment.

The density of the third segment is 0.26 g/cc, and the density of the fourth segment is 0.15 g/cc. The actual density differential between the combined first and third segments and the combined second and fourth segments is about −31. The density differential is believed to be provided by the combined effects of the varying packing densities of the segments and the varying densities of the blends used in forming the segments.

Filter plugs having lengths of 24 mm and the diameters of 24.8 mm are provided. The filter plugs include a cylindrical cellulose acetate element circumscribed by an air permeable paper plug wrap. Each filter plug is aligned with each rod in an abutting end-to-end relation such that the plug is adjacent the second segment of the rod. The filter plug is attached to the rod with circumscribing micromechanical perforated tipping paper such that the resulting filter cigarette exhibits 28 percent air dilution.

The resulting filter cigarette is designated as Sample No. 1.

EXAMPLE 2

Varying amounts of the volume expanded and unexpanded portions of a tobacco blend substantially as described in Example 1 are blended to provide a relatively high density blend having nicotine content of 2.36 percent.

In a similar manner, varying amounts of the volume expanded and unexpanded portions of a tobacco blend substantially as described in Example 1 are blended to provide a relatively low density blend having a nicotine content of 1.82 percent.

Cylindrical cigarette rods of 60 mm length and 24.8 mm circumference are provided from each of the two aforementioned tobacco blends and conventional air permeable cigarette paper using an apparatus generally described in U.S. Pat. No. 4,009,722 to Wahle et al. There is also provided a trimmer disk positioned so as to provide "dense ends" to each of the rods so formed. The first and second segments of the rods so provided are the "dense ends" produced by the trimmer disk. The rods so manufactured have first and third segments provided from the high density blend. The first and third segments have combined longitudinally extending lengths of 24 mm. The second and fourth segments of the manufactured rods are provided from the low density blend. The second and fourth segments have combined longitudinally extending lengths of 36 mm. The first segment extends 12.5 mm longitudinally along the rod and exhibits an average density of about 4 percent greater than the adjacent third segment. The second segment extends 12.5 mm longitudinally along the rod and exhibits an average density of about 4 percent greater than the adjacent fourth segment.

The density of the third segment is 0.232 g/cc, and the density of the fourth segment is 0.178 g/cc. The actual density differential between the combined first and third segments and the combined second and fourth segments is about −16.8. The density differential is believed to be provided by the combined effects of the varying packing densities of the segments and the varying densities of the blends used in forming the segments.

Filter plugs having lengths of 24 mm and diameters of 24.8 mm are provided. The filter plugs include a cylindrical cellulose acetate element circumscribed by an air permeable paper plug wrap. Each filter plug is aligned with each rod in an abutting end-to-end relation such that the plug is adjacent the second segment of the rod. The filter plug is attached to the rod with circumscribing micromechanical perforated tipping paper such that the resulting filter cigarette exhibits 28 percent air dilution.

The resulting filter cigarette is designated as Sample No. 2.

EXAMPLE 3

For comparison purposes are provided two commercially available filter cigarettes. Each commercially available cigarette includes a tobacco rod and a cellulose acetate filter element attached thereto. Each commercially available filter cigarette is labeled as Sample No. C-1 and Sample No. C-2, respectively. Sample No. C-1 has a tobacco rod length of 57 mm and a filter length of 27 mm. Sample No. C-2 has a tobacco rod length of 63 mm and a filter length of 21 mm. The total FTC "tar" and nicotine values for Sample Nos. 1, 2, C-1 and C-2 are presented in Table I.

TABLE I

| Sample | Nicotine (mg) | Tar (mg) |
|---|---|---|
| 1 | 0.90 | 10.5 |
| 2 | 0.92 | 9.8 |
| C-1* | 0.66 | 8.6 |
| C-2* | 1.11 | 16.6 |

*not an example of the invention.

The puff-by-puff profiles of "tar" and nicotine for Sample Nos. 1, 2, C-1 and C-2 are provided using a smoking machine and modules. The smoking machine and modules required for puff-by-puff analysis are similar to an apparatus commercially available from Heinr. Borgwaldt GmbH, Hamburg, West Germany. In this manner smoke delivery profiles for the various samples are provided. As used herein the term "smoke delivery profile" in referring to a cigarette means the profile of provided, collected and analyzed smoke components, on a puff-by-puff basis when the cigarette is smoked under standard FTC (i.e, U.S. Federal Trade Commission) conditions.

Data are presented in Table II.

TABLE II

| | Sample | | | | | | | |
|---|---|---|---|---|---|---|---|---|
| | 1 | | 2 | | C-1* | | C-2* | |
| Puff No. | Nicotine (mg) | Tar (mg) | Nicotine (mg) | Tar (mg) | Nicotine (mg) | Tar (mg) | Nicotine (mg) | Tar (mg) |
| 1 | 0.046 | 0.65 | 0.044 | 0.59 | 0.032 | 0.56 | 0.043 | 0.81 |
| 2 | 0.085 | 0.98 | 0.081 | 0.92 | 0.060 | 0.85 | 0.078 | 1.20 |
| 3 | 0.108 | 1.17 | 0.102 | 1.05 | 0.071 | 0.96 | 0.103 | 1.34 |
| 4 | 0.118 | 1.29 | 0.113 | 1.17 | 0.080 | 1.11 | 0.113 | 1.49 |
| 5 | 0.127 | 1.40 | 0.121 | 1.27 | 0.084 | 1.14 | 0.121 | 1.64 |
| 6 | 0.138 | 1.54 | 0.123 | 1.36 | 0.090 | 1.24 | 0.132 | 1.76 |
| 7 | 0.150 | 1.73 | 0.131 | 1.48 | 0.092 | 1.27 | 0.142 | 1.91 |
| 8 | 0.157 | 1.92 | 0.139 | 1.66 | 0.092 | 1.31 | 0.148 | 1.98 |
| 9 | — | — | — | — | — | — | 0.153 | 2.14 |

*not an example of the invention.

The data in Table II indicate that the puff-by-puff deliveries of delivered "tar" and nicotine for Sample Nos. 1 and 2 very nearly approximate those deliveries of Sample No. C-2 (i.e., the full flavored comparative sample) during the first 6 puffs and approximate those deliveries of Sample No. C-2 during puffs 7 and 8. However, as indicated in Table I, the total FTC delivery of "tar" and nicotine for Sample No. C-2 is substantially higher than for each of Sample Nos. 1 and 2. Thus, Sample Nos. 1 and 2 appear to be capable of providing a perception of strength which is similar to a full flavor product while delivering lower total amounts of "tar."

What is claimed is:

1. A rod suitable for the manufacture of a cigarette, said rod comprising smokable filler material contained in a wrapping material and having the two ends thereof open to expose the filler material, said rod further comprising four segments of filler material, each segment being defined by its density, wherein (i) the first segment is disposed at the extreme end of the rod which is to be lit;

(ii) the second segment is disposed at the end of the rod opposite the end which is to be lit;

(iii) the third segment is disposed adjacent to the first segment; and (iv) the fourth segment is disposed adjacent to the second segment;

wherein each of the third segment and the fourth segment has a substantially uniform density in the region along the longitudinal axis of the rod and across the rod in a plane perpendicular to the longitudinal axis thereof, and the density of the fourth segment is less than that of the third segment such that the density differential therebetween is at least about 15 percent.

2. The rod of claim 1 wherein all of said filler material is smokable material.

3. The rod of claim 1 wherein the first segment and the second segment each have a density greater than the segment adjacent to each of the respective first and second segments.

4. The rod of claim 3 wherein the combined longitudinal length of the second segment and the fourth segment extend from about 20 to about 80 percent of the total length of the rod.

5. The rod of claim 3 wherein the combined longitudinal length of the second segment and the fourth segment extend from about 30 to about 70 percent of the total length of the rod.

6. The rod of claim 1 wherein the first segment and the second segment each have a density less than the segment adjacent to each of the respective first and second segments.

7. The rod of claim 6 wherein the combined longitudinal length of the second segment and the fourth segment extend from about 20 to about 80 percent of the total length of the rod.

8. The rod of claim 6 wherein the combined longitudinal length of the second segment and the fourth segment extend from about 30 to about 70 percent of the total length of the rod.

9. The rod of claim 1 wherein the first segment has a density less than the third segment and the second segment has a density greater than the fourth segment.

10. The rod of claim 1 wherein the first segment has a density greater than the third segment and the second segment has a density less than the fourth segment.

11. The rod of claim 2 wherein the relative nicotine content of the third segment is greater than that of the fourth segment.

12. The rod of claim 2 wherein the relative nicotine content of the third segment is less than that of the fourth segment.

13. The rod of claim 2 wherein each of the four segments have essentially equal relative nicotine contents.

14. The rod of claim 1 wherein the density differential is between about 20 percent and about 270 percent.

15. The rod of claim 1 wherein the density differential is between about 30 percent and about 130 percent.

16. The rod of claim 2 wherein the smokable material of each segment is a blend of smokable materials.

17. The rod of claim 16 wherein the blend of smokable materials is a blend of tobaccos.

18. The rod of claim 2 wherein the smokable material of the second and fourth segments is the volume expanded form of the smokable material of the first and third segments.

19. The rod of claim 16 wherein the blend of filler materials of the first and third segments is the same as the blend of filler materials of the second and fourth segments.

20. The rod of claim 16 wherein the blend of filler materials of the first and third segments is different from the blend of filler materials of the second and fourth segments.

21. The rod of claim 2 wherein the smokable material of the first and third segments is volume expanded.

22. The rod of claim 2 wherein the smokable material of the second and fourth segments is volume expanded.

23. A filter cigarette comprising the rod of claim 1 and an attached filter plug axially aligned therewith at the end of the rod adjacent to the second segment thereof.

* * * * *